US005604062A

United States Patent [19]

Okazaki et al.

[11] Patent Number: 5,604,062

[45] Date of Patent: Feb. 18, 1997

[54] ORGANIC PHOTOCONDUCTOR WITH CROSSLINKED POLYPHENYLENE SULFIDE SUPPORT FOR ELECTROPHOTOGRAPHY

[75] Inventors: Tatsuro Okazaki, Nagano; Noriaki Kawata, Saitama, both of Japan

[73] Assignee: Fuji Electric Co., Ltd., Tokyo, Japan

[21] Appl. No.: 613,073

[22] Filed: Mar. 8, 1996

[30] Foreign Application Priority Data

Mar. 10, 1995 [JP] Japan ..... 7-050671

[51] Int. Cl.[6] ..... G03G 5/10

[52] U.S. Cl. ..... 430/58; 430/63; 430/65; 430/69; 430/59

[58] Field of Search ..... 430/58, 69

[56] References Cited

U.S. PATENT DOCUMENTS 5,512,399 4/1996 Kawata et al. ..... 430/69

FOREIGN PATENT DOCUMENTS 59-154460 9/1984 Japan ..... 430/69

*Primary Examiner*—Roland Martin

*Attorney, Agent, or Firm*—Brumbaugh, Graves, Donohue & Raymond

[57] ABSTRACT

In an organic photoconductor for electrophotography, improved adhesiveness is realized between a substrate that contains a crosslinked polyphenylene sulfide as its main component and an organic photoconductor layer on the substrate. The substrate is cylindrical and conductive. With A denoting the thermal expansion coefficient of the substrate and B denoting the thermal expansion coefficient of the organic photoconductor layer, the improvement is realized when $\frac{1}{2} \geqq A/B \geqq \frac{1}{4}$.

11 Claims, 2 Drawing Sheets

ORGANIC PHOTOCONDUCTOR WITH CROSSLINKED POLYPHENYLENE SULFIDE SUPPORT FOR ELECTROPHOTOGRAPHY

FIELD OF THE INVENTION

The present invention relates to organic photoconductors for electrophotography, and more specifically to organic photoconductors which comprise a conductive substrate that contains a polyphenylene sulfide resin as its main component.

BACKGROUND OF THE INVENTION

Organic photoconductors, used in electrophotographic apparatuses such as copying machines or printers employing electrophotographic techniques, conventionally comprise a conductive substrate and an organic photoconductive layer laminated on the conductive substrate. The photoconductive layer is made of organic materials including an organic photoconductive material. The conductive substrate is usually cylindrical due to design specifications of the electrophotographic apparatuses. The photoconductive layer, a thin film that contains an organic photoconductive material, is formed on the outer surface of the cylindrical substrate.

Aluminum or aluminum alloys which are light in weight and which have excellent machinability have been widely used as substrate materials. However, it is necessary to machine with high precision the outer surface of each cylindrical aluminum or aluminum alloy substrate to meet the dimensional specifications (circularity: ±50 μm or less, diameter: ±40 μm or less) and to realize the preferred surface roughness (0.5 to 1.2 μm for the maximum height $R_{MAX}$). It is also necessary to insert a flange for precise rotation in forming a photoconductor layer by layer. And since the surface of an aluminum or aluminum alloy substrate is susceptible to oxidation or transformation by atmospheric oxygen or moisture, countermeasures are necessary such as providing the substrate surface with a protective anodized oxide film. Thus, aluminum or aluminum alloy substrates have been manufactured through many manufacturing steps and at high manufacturing cost.

Japanese Patent Document No. H02-17026 discloses a cylindrical substrate that is lighter in weight, chemically and thermally highly resistant, neither oxidized nor deformed in air, and suitable for organic photoconductors. The cylindrical substrate is manufactured by injection molding of materials including a polyphenylene sulfide resin (hereinafter referred to as "PPS resin").

With a volume resistivity of pure PPS resin of $10^{14}$ to $10^{16}$ Ω·cm, electrical conductivity of such a substrate is too low for the photoconductor to be viable in electrophotography. For obtaining images or prints clear enough for practical use, the volume resistivity of the substrate should be less than $10^4$ Ω·cm. A volume resistivity exceeding $10^5$ Ω·cm hinders the electric charges from transferring to the substrate during light exposure or discharge and raises the remanent potential. Thus, the high volume resistivity of PPS resin makes it unsuitable for obtaining clear images or prints. Carbon black is added, for example, to provide the PPS resin with enhanced electrical conductivity. Since the volume resistivity of carbon black such as conductive furnace carbon is $10^{-1}$ to 10 Ω·cm, it is necessary to add as much as 15 weight % carbon black to the PPS resin to reduce the volume resistivity of the substrate to $10^4$ Ω·cm. However, the addition of carbon black has its limits, as large amounts of carbon black addition reduce the mechanical strength of the substrate. Moreover, it is difficult to attain the required dimensional substrate precision if the substrate is made of normal linear PPS resin which, as compared with crosslinked PPS, is deformed more easily by the solvent of a coating liquid or by heating.

Though the PPS resin substrate has excellent chemical resistivity as described above, the adhesiveness of the PPS resin substrate to the organic photoconductive layer formed thereon is low, which may result in peeling of the coated and dried photoconductive layer from the substrate. Moreover, peeling of the photoconductive layer from the substrate can be caused in practical use by repeated contact with other parts and components of the electrophotographic apparatus. Thus, the production efficiency of the PPS resin substrate is low and its product life is short.

SUMMARY OF THE INVENTION

It is an object of the present invention to provide an organic photoconductor for electrophotography so as to obviate the aforementioned problems of moldability, strength and dimensional precision of the conventional PPS resin substrate, to prevent peeling of the photoconductive layer, and to prolong the product life of the organic photoconductor.

According to the present invention, there is provided an organic photoconductor for electrophotography that comprises a cylindrical conductive substrate containing a crosslinked polyphenylene sulfide resin, an electrically conductive powder and inorganic fiber, and having a thermal expansion coefficient A, and an organic photoconductive layer coated on the conductive substrate and having a thermal expansion coefficient B, the thermal expansion coefficients A and B being such that $\frac{1}{2} \geqq A/B \geqq \frac{1}{4}$. The electrically conductive powder is preferably carbon black, and the inorganic fiber is preferably glass fiber. The thermal expansion coefficient A of the conductive substrate is preferably from $2.0\times10^{-5}$ to $4.0\times10^{-5}$ $K^{-1}$. The thermal expansion coefficient B of the organic photoconductive layer is preferably from $6.0\times10^{-5}$ to $10\times10^{-5}$ $K^{-1}$. The content of the polyphenylene sulfide resin in the conductive substrate is preferably from 40 to 65 weight %. The organic photoconductive layer can comprise an undercoating layer, a charge generation layer and a charge transport layer. The undercoating layer can comprise a melamine resin and metal oxide powder, with the thermal expansion coefficient thereof being lower than the thermal expansion coefficient of the melamine resin. Alternatively, the undercoating layer can comprise a polyamide resin and metal oxide powder, with the thermal expansion coefficient thereof being lower than the thermal expansion coefficient of the polyamide resin. The charge generation layer can comprise a poly(vinyl chloride) resin. The charge transport layer can comprise a polycarbonate resin. The organic photoconductive layer can consist of a single layer.

BRIEF DESCRIPTION OF THE DRAWINGS

FIG. 2(*b*) is a cross section taken along X—X of FIG. 2 (*a*).

DETAILED DESCRIPTION

The adhesiveness in a photoconductor between a conductive substrate made of crosslinked polyphenylene sulfide resin (PPS resin) and an organic photoconductive layer is improved by setting the ratio of the thermal expansion coefficients of the substrate and the photoconductive layer within a preferred range. More specifically, the adhesiveness between the cylindrical conductive substrate, made of a crosslinked PPS resin, conductive powder and inorganic fiber and having a thermal expansion coefficient A, and the organic photoconductive layer, formed on the conductive substrate and having a thermal expansion coefficient B, is improved by setting the thermal expansion coefficient ratio A/B to be $\frac{1}{2} \geqq A/B \geqq \frac{1}{4}$. For example, by drying the coated organic photoconductive layer at 100° to 160° C., the adhesiveness is considered to be improved by the compressive stress that the photoconductive layer exerts on the substrate at room temperature, since the thermal expansion coefficient of the photoconductive layer is larger than that of the substrate. The tensile stress exerted on the photoconductive layer should not cause any problems, since the photoconductive layer is elastic. However, if the ratio A/B is less than ¼, peeling of the photoconductive layer may be caused by the large difference in the thermal expansion coefficients. By choosing the thermal expansion coefficient ratio A/B between ½ and ¼, peeling of the photoconductive layer is prevented after drying and in its use in a copier or printer. The electrostatic properties of the organic photoconductor for electrophotography are negligibly affected by the measures taken according to the present invention.

Figure 1:
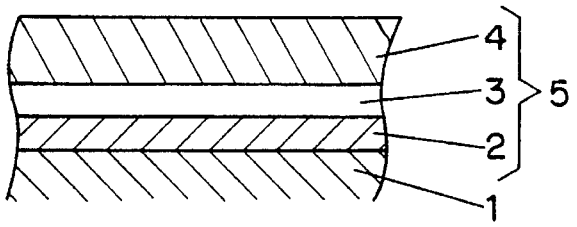
FIG. 1 is a schematic cross section of a layer structure of an embodiment of an organic photoconductor for electrophotography according to the present invention.
Figure 2A:
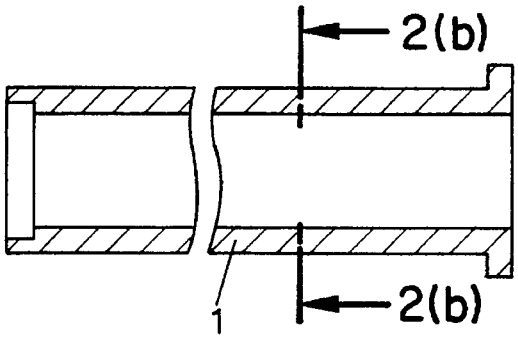
FIG. 2(*a*) is a longitudinal cross section of an embodiment of a substrate for the organic photoconductor of FIG. 1.
Figure 2B:
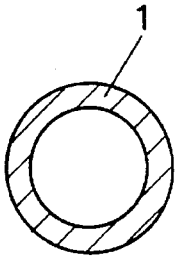

In FIG. 1, a preferred organic photoconductor is shown with a PPS resin substrate 1 on which is formed a photoconductive layer 5 that consists of an undercoating layer 2 laminated on the substrate 1, a charge generation layer 3 laminated on the undercoating layer 2, and a charge transport layer 4 laminated on the charge generation layer 3. The undercoating layer 2 may be omitted.

Figure 3:
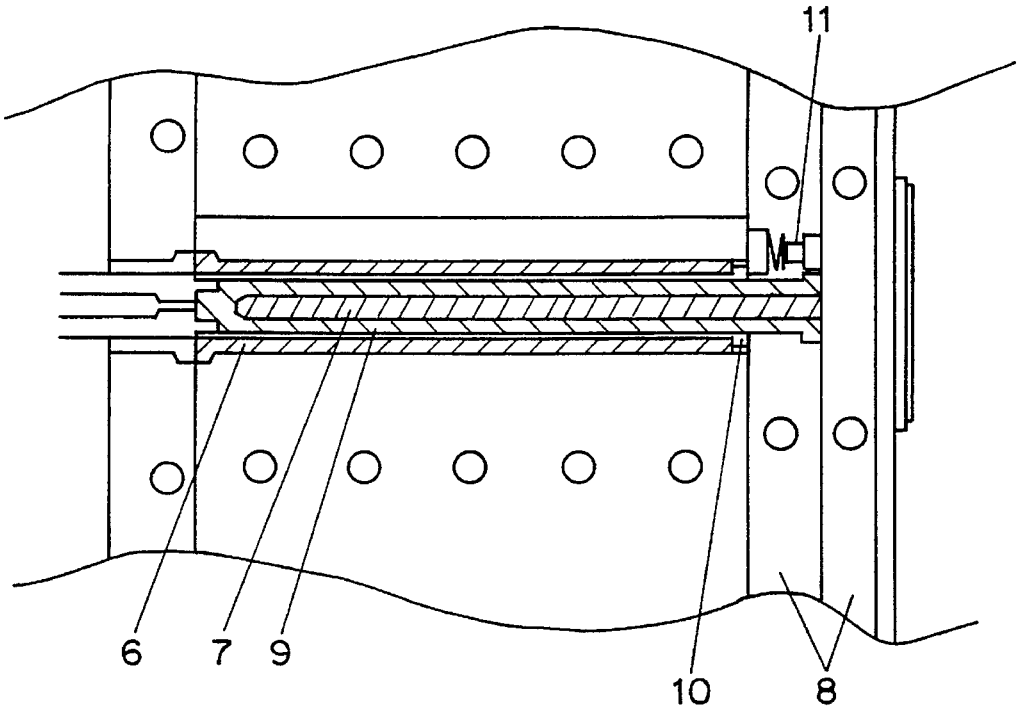
FIG. 3 is a cross section of the main part of a molding die for molding a PPS resin substrate.

For PPS resin substrates, Table 1 lists mixing ratios of the PPS resin and the additives for two preferred substrates D1 and D2, and for a comparison substrate D3. From such mixtures, substrates D1, D2, and D3 were formed by injection molding in a molding die as shown in FIG. 3, all under the same conditions as listed in Table 2. The substrates D1, D2, and D3 were formed into cylinders, 30 mm in outer diameter, 260.5 mm in length, 28.5 mm in inner diameter on the thin side, and 26.5 mm in inner diameter on the thick side. Thus, the cylindrical substrates D1, D2, and D3 have an inner surface which slants by about 0.23 degrees of angle with respect to the rotation axis of the substrate cylinder.

TABLE 1

| Substrate materials | Mixing ratios (weight %) Embodiment substrate D1 | Embodiment substrate D2 | Comparison substrate D3 |
|---|---|---|---|
| Cross-linked PPS resin | 60 | 40 | 70 |
| Carbon black | 15 | 20 | 15 |
| Clay | 10 | 20 | 10 |
| Glass fiber | 15 | 20 | 5 |

TABLE 2

| Conditions for formation | Substrates D1, D2, D3 |
|---|---|
| Cylinder temperature (°C.) | |
| Rear part | 280 |
| Middle part | 290 |
| Front part | 300 |
| Nozzle temperature (°C.) | 310 |
| Molding die temp. (°C.) | 150 |
| Injection pressure ($\times 10^8$ N/m$^2$) | 1.62 |
| Charging time (sec) | 0.1 |
| Cooling period (sec) | 30 |

With respect to molding, FIG. 3 shows the closed state of the molding die, with the end faces of a cavity die 6 and a fixed die 8 in tight mutual contact. A core die 7 is linked and fixed to the fixed die 8, and material charged into a cavity 9 is molded into a molding. The cavity die 6 and the fixed die 8 can be separated from one another by releasing the bolt 11. As the core die 7 linked to the fixed die 8 is pulled out, the temperature of the molding in the cavity 9 decreases. Since the molding shrinks radially as the temperature decreases, the molding can be removed from the die without damaging its surface portions.

Figure 4:
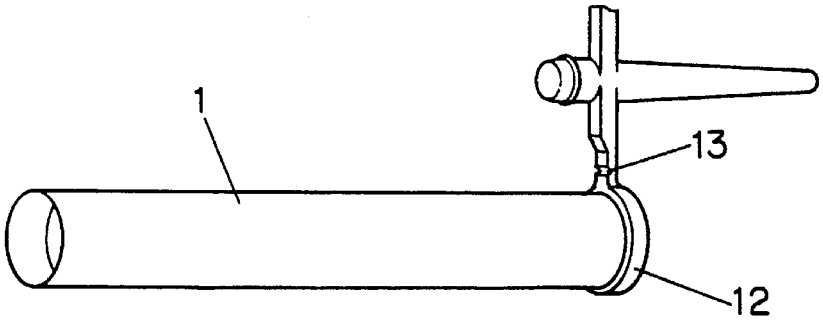
FIG. 4 is an isometric view of a molding from the molding die of FIG. 3.

As shown in FIG. 4, a resulting molding 1 has a convex ring 12 corresponding to a step 10 of the cavity die 6, and a portion of a side gate 13 from where the resin was injected. The PPS resin substrate is finished by removing these portions without leaving any traces thereof.

Preferred and comparison photoconductors were fabricated on the PPS resin substrates D1, D2 and D3 with different material combinations for the organic photoconductive layer. Beforehand, conductive substrate surfaces were exposed for 15 to 25 seconds to ultraviolet rays of 184.9 nm and 253.7 nm in wavelength from a low-pressure mercury lamp spaced 20 mm from the substrate surface. The mercury lamp was driven at 200 W by an ultraviolet light irradiation apparatus Type SUV200NS supplied by Sun Engineering. The irradiation with ultraviolet rays was carried out to improve the surface activity of the substrate so as to improve adhesion with the photoconductive layer by cutting the bonds of PPS molecules and/or by forming OH and/or COOH groups on the surface of the substrate surface. The adhesiveness of the substrate may be improved also by corona discharge.

Table 3 lists the volume resistivity, moldability, mechanical strength, chemical resistance (measured by the change of mass caused by immersion in methylene chloride for 2 hrs), precision of external dimensions, rate of change of dimensions caused by heat treatment at 120° C. for 48 hrs, and thermal expansion coefficient (between 0° and 100° C.) which were measured for each fabricated substrate. Here and in Table 5 below, the symbol ○ stands for "satisfactory".

TABLE 3

| Evaluation item of substrates | Embodiment substrate D1 | Embodiment substrate D2 | Comparison substrate D3 |
|---|---|---|---|
| Volume resistivity (Ω · cm) | $2 \times 10^3$ | $2 \times 10^2$ | $2 \times 10^4$ |
| Moldability | o | o | o |
| Mechanical strength ($\times 10^8$ N/m$^2$) | 0.68 | 0.68 | 0.60 |
| Chemical resistance | o | o | o |
| Precision of external dimensions (mm) | 0.05 | 0.03 | 0.06 |
| Rate of change of volume (%) | 0 | 0 | 0.3 |
| Thermal expansion coefficient ($K^{-1}$) | $3.3 \times 10^{-5}$ | $2.0 \times 10^{-5}$ | $5.5 \times 10^{-5}$ |

For a first embodiment, an undercoating layer 2 was formed to a thickness of 10 μm on the PPS resin substrate D2 by immersing the substrate D2 in a coating liquid and drying the liquid coating. The coating liquid contained 100 weight parts of a melamine resin (Uban 62 supplied by Mitsui Toatsu Chemicals Inc., thermal expansion coefficient $5.0\times 10^{-5}$ $K^{-1}$), 20 weight parts of phthalic anhydride, 6 weight parts of iodine and 50 weight parts of titanium dioxide of rutile structure (R-820 supplied by ISHIHARA SANGYO KAISHA, LTD., thermal expansion coefficient $5.0\times10^{-6}$ $K^{-1}$) dissolved in a mixed solvent containing 1 weight part of xylene and 1 weight part of butanol.

Figure 5:
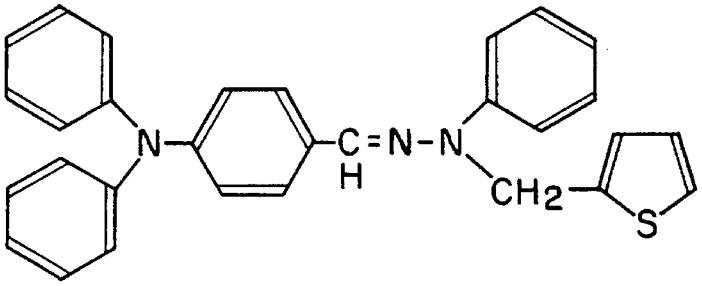
FIG. 5 is a chemical formula for a first hydrazone compound.

A coating liquid for a charge generation layer 3 was prepared by mixing and dispersing 10 weight parts of X-type metal-free phthalocyanine (FASTGEN BLUE 8120 supplied by DAINIPPON INK & CHEMICALS INC.) and 10 weight parts of a vinyl chloride resin (MR-110 supplied by Nippon Zeon Co., Ltd.) into 686 weight parts of dichloromethane and 294 weight parts of 1,2-dichloroethane for an hour in a mixer and for 30 min in an ultrasonic dispersing machine. The charge generation layer 3 was formed on the undercoating layer 2 to a thickness of about 0.5 μm by immersion coating of the coating liquid and by drying the liquid coating at 80° C. for 30 min. A charge transport layer 4 was formed on the charge generation layer 3 to a thickness of about 20 μm by immersion coating of a coating liquid consisting of 100 weight parts of a hydrazone compound (prepared by Fuji Electric Co., Ltd, and described by the chemical formula of FIG. 5), 100 weight parts of polycarbonate Z resin (Iupilon PCZ supplied by MITSUBISHI GAS CHEMICAL CO., INC.) and 800 weight parts of dichloromethane, and by drying the liquid coating at 90° C. for an hour. The thermal expansion coefficient of the resulting organic photoconductive laminate 5 was $6.6\times10^{-5}$ $K^{-1}$.

For a second embodiment, a coating liquid for an undercoating layer was prepared by dissolving 10 weight parts of an alcohol-soluble polyamide resin (AMIRAN C8000 supplied by TORAY INDUSTRIES, INC., thermal expansion coefficient $1\times10^{-4}$ $K^{-1}$), and 5 weight parts of titanium dioxide of futile structure (R-820 supplied by ISHIHARA SANGYO KAISHA, LTD., thermal expansion coefficient $5.0\times10^{-6}$ $K^{-1}$) in 85 weight parts of methanol. The undercoating layer 3 was formed to a thickness of 3.0 μm on the PPS resin substrate D1 by immersion coating of the coating liquid and by drying the liquid coating at 120° C. for 15 min.

Figure 6:
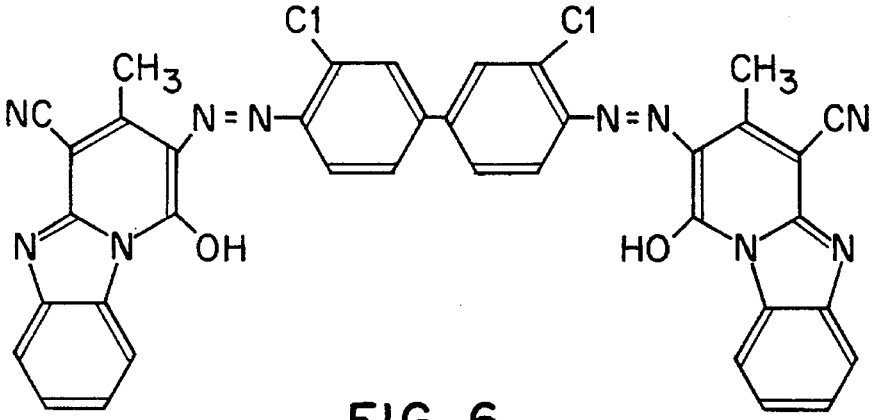
FIG. 6 is a chemical formula for an azo compound.

A coating liquid for a charge generation layer 3 was prepared by dispersing in a sand mill 2.1 weight parts of an azo compound (described by the chemical formula of FIG. 6), 1.0 weight part of poly(vinyl acetal) (S·LEC KS-1 supplied by Sekisui Chemical Co., Ltd.) in 16 weight parts of methyl ethyl ketone and 9 weight parts of cyclohexane, and by adding 75 weight parts of methylethyl ketone. The charge generation layer 3 was formed to a thickness of 0.2 μm.

Figure 7:
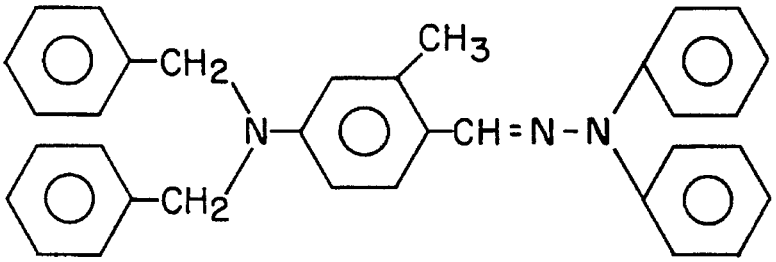
FIG. 7 is a chemical formula for a second hydrazone compound.

A charge transport layer 4 was formed on the charge generation layer 3 to a thickness of about 20 μm by immersion coating of a coating liquid consisting of 10 weight parts of a hydrazone compound (prepared by Fuji Electric Co., Ltd, and described by the chemical formula of FIG. 7), 10 weight parts of polycarbonate A resin (Panlite-1250 supplied by TEIJIN LTD.) and 800 weight parts of chloroform, and by drying the liquid coating at 90° C. for an hour. The thermal expansion coefficient of the resulting organic photoconductive laminate 5 was $7.5\times10^{-5}$ $K^{-1}$.

Photoconductors of the third through sixth embodiments were fabricated similar to the first embodiment except for the combination of the substrate and the binder resin for the charge transport layer. The PPS substrate was D2 and the binder resin was PMMA resin for the third embodiment. The PPS substrate was D1 and the binder resin was polyester resin for the fourth embodiment. The PPS substrate was D2 and the binder resin was epoxy resin for the fifth embodiment. And the PPS substrate was D1 and the binder resin was polyacetal resin for the sixth embodiment.

Two comparison examples were formed also. A comparison photoconductor example 1 was fabricated by laminating an organic photoconductive layer 5 on the comparison substrate D3, under the same conditions as for the first embodiment. A comparison photoconductor example 2 was fabricated by coating on the substrate D2 an organic photoconductive layer 5 under the same conditions as for the first embodiment, except for the polyacetal resin used as the binder resin for the charge transport layer. Table 4 shows the thermal expansion coefficients of the six photoconductor embodiments and the two comparison examples.

TABLE 4

| | Substrates | | |
|---|---|---|---|
| | Embodiment substrate D1 | Embodiment substrate D2 | Comparison substrate D3 |
| Photoconductive layers | $3.5 \times 10^{-5}$ | $2.0 \times 10^{-5}$ | $5.5 \times 10^{-5}$ |
| 1st embodiment | | $6.6 \times 10^{-5}$ | |
| 2nd embodiment | $7.5 \times 10^{-5}$ | | |
| 3rd embodiment | | $8.0 \times 10^{-5}$ | |
| 4th embodiment | $7.5 \times 10^{-5}$ | | |
| 5th embodiment | | $6.0 \times 10^{-5}$ | |
| 6th embodiment | $8.5 \times 10^{-5}$ | | |
| Comparison 1 | | $8.5 \times 10^{-5}$ | |
| Comparison 2 | | | $6.6 \times 10^{-5}$ |

The cross-cut adhesion test as specified by JIS K5400 was carried out on the above-described photoconductor embodiments and the comparison photoconductors. Image quality was compared between a conventional copying machine and a laser beam printer on which one of the above-described photoconductor embodiments or comparison examples had been installed, and the number of images obtained before peeling of the photoconductive layer was determined. The results are listed in Table 5 where the symbol Δ stands for "unsatisfactory".

As Table 5 shows, there was no peeling in the cross-cut adhesion tests for the listed embodiments. No black spots or voids occurred in the printing test with the photoconductor embodiments. Prints with high contrast and images with excellent gradation were obtained with the photoconductor embodiments. In contrast, there was frequent peeling and there were many image defects such as black spots and voids in the case of the comparison photoconductors, so that the comparison photoconductors have a short product life.

TABLE 5

| Photoconductors | Cross-cut adhesion test (Number of peeling) | Continuous imaging life (Sheets) | Image quality |
|---|---|---|---|
| 1st embodiment | 0/100 | 50000 | o |
| 2nd embodiment | 0/100 | 50000 | o |
| 3rd embodiment | 0/100 | 50000 | o |
| 4th embodiment | 0/100 | 50000 | o |
| 5th embodiment | 0/100 | 50000 | o |
| 6th embodiment | 0/100 | 50000 | o |
| Comparison 1 | 30/100 | 5000 | Δ |
| Comparison 2 | 10/100 | 10000 | Δ |

As described, the adhesiveness between the cylindrical conductive substrate, made of a crosslinked polyphenylene sulfide resin, conductive powder and inorganic fiber and having a thermal expansion coefficient A, and the organic photoconductive layer, formed on the conductive substrate and having a thermal expansion coefficient B, is improved by setting the thermal expansion coefficient ratio A/B to be $\frac{1}{2} \geqq A/B \geqq \frac{1}{4}$. An organic photoconductor with excellent electrophotographic properties and a long product life is obtained by improved adhesiveness between the conductive layer and the PPS resin substrate without deteriorating the moldability, mechanical strength, precision of the external dimensions and changing rate of the dimensions of the PPS resin substrate.

Though the present invention has been described by way of the embodiments of organic photoconductors which comprise an undercoating layer, a charge generation layer and a charge transport layer, it will be apparent to those skilled in the art that the present invention is applicable also, without departing from the spirit of the invention, to photoconductors which comprise a single-layered photoconductive layer so long as the thermal expansion coefficients of the crosslinked PPS resin substrate and the photoconductive layer satisfy the aforementioned condition. And, though the present invention has been explained by way of carbon black and glass fiber as the conductive powder and the inorganic fiber added to the polyphenylene sulfide resin for the cylindrical conductive substrates, it will be apparent also that other combinations of conductive powder such as metal powder or metal oxide powder and inorganic fibers such as carbon fiber or metal fiber are effective so long as the thermal expansion coefficients of the crosslinked PPS resin substrate and the photoconductive layer satisfy the aforementioned condition.

We claim:

1. An organic photoconductor for electrophotography comprising:

a cylindrical conductive substrate comprising a crosslinked polyphenylene sulfide resin, electrically conductive powder and inorganic fiber and having a thermal expansion coefficient A, and an organic photoconductive layer coated on the conductive substrate and having a thermal expansion coefficient B, wherein $\frac{1}{2} \geqq A/B \geqq \frac{1}{4}$.

2. The organic photoconductor of claim 1, wherein the electrically conductive powder comprises carbon black and the inorganic fiber comprises glass fiber.

3. The organic photoconductor of claim 2, wherein the thermal expansion coefficient A of the conductive substrate is from $2.0\times10^{-5}$ to $4.0\times10^{-5}$ $K^{-1}$.

4. The organic photoconductor of claim 2, wherein the thermal expansion coefficient B of the photoconductive layer is from $6.0\times10^{-5}$ to $10\times10^{-5}$ $K^{-1}$.

5. The organic photoconductor of claim 1, wherein the polyphenylene sulfide resin is included in the conductive substrate in an amount from 40 to 65 percent by weight.

6. The organic photoconductor of claim 1, wherein the photoconductive layer comprises an undercoating layer, a charge generation layer and a charge transport layer.

7. The organic photoconductor of claim 6, wherein the undercoating layer comprises a melamine resin and a metal oxide powder having respective thermal expansion coefficients, the thermal expansion coefficient of the metal oxide powder being less than the thermal expansion coefficient of the melamine resin.

8. The organic photoconductor of claim 6, wherein the undercoating layer comprises a polyamide resin and a metal oxide powder having respective thermal expansion coefficients, the thermal expansion coefficient of the metal oxide powder being less than the thermal expansion coefficient of the polyamide resin.

9. The organic photoconductor of claim 6, wherein the charge generation layer comprises a poly(vinyl chloride) resin.

10. The organic photoconductor of claim 6, wherein the charge transport layer comprises a polycarbonate resin.

11. The organic photoconductor of claim 1, wherein the photoconductive layer consists of a single layer.

* * * * *

UNITED STATES PATENT AND TRADEMARK OFFICE
CERTIFICATE OF CORRECTION

ATENT NO. : 5,604,062

ATED : February 18, 1997

IVENTOR(S) : Okazaki et al.

It is certified that error appears in the above-identified patent and that said Letters atent is hereby corrected as shown below:

On title page, item [54] and col. 1, line 3, delete "SUPPORT"

olumn 5, line 59, "futile" should read --rutile--.

Signed and Sealed this

Fourth Day of November, 1997

*Attest:*

*Attesting Officer*

BRUCE LEHMAN

*Commissioner of Patents and Trademarks*